United States Patent [19]

Holtier

[11] Patent Number: 5,011,451

[45] Date of Patent: Apr. 30, 1991

[54] MUSIC BOX SUBASSEMBLY AND A VEHICLE STRUCTURE INCLUDING THE SAME

[75] Inventor: Eugene S. Holtier, Olmsted Twp., Lorain County, Ohio

[73] Assignee: Those Characters From Cleveland, Inc., Cleveland, Ohio

[21] Appl. No.: 486,136

[22] Filed: Feb. 28, 1990

[51] Int. Cl.[5] ..... A63H 5/00; A63H 17/34; A63H 29/24; G10F 1/06

[52] U.S. Cl. ..... 446/409; 446/414; 446/461; 446/469; 84/94.2; 84/95.2

[58] Field of Search ..... 84/94.2, 95.2; 446/409, 446/410, 414, 413, 404, 440, 448, 449, 461, 463, 469

[56] References Cited

U.S. PATENT DOCUMENTS

| | | | |
|---|---|---|---|
| 530,584 | 12/1894 | Eccleston | 446/413 |
| 1,667,125 | 4/1928 | Majewicz | 446/397 |
| 2,552,288 | 5/1951 | Lee | 84/95.2 X |
| 2,630,655 | 3/1953 | Duncan | 446/414 |
| 2,831,291 | 4/1958 | Muessel | 446/414 |
| 2,908,997 | 10/1959 | Handler | 446/414 |
| 2,961,911 | 11/1960 | Duncan | 84/97 |
| 2,988,847 | 6/1961 | Smith | 446/283 |
| 3,083,500 | 4/1963 | Balthazor | 446/466 |
| 4,245,425 | 1/1981 | D'Andrade | 446/271 |
| 4,281,575 | 8/1981 | Nakamura | 84/718 |
| 4,285,159 | 8/1981 | Bass et al. | 446/410 |
| 4,516,952 | 5/1985 | Brand et al. | 445/427 |
| 4,568,307 | 2/1986 | Gabler et al. | 446/448 |
| 4,915,633 | 4/1990 | Auer et al. | 446/449 X |

FOREIGN PATENT DOCUMENTS

| | | | |
|---|---|---|---|
| 670854 | 1/1939 | Fed. Rep. of Germany | 446/461 |
| 77599 | 2/1962 | France | 446/409 |
| 490613 | 8/1938 | United Kingdom | 446/414 |
| 740804 | 11/1955 | United Kingdom | 446/414 |
| 1211120 | 11/1970 | United Kingdom | 446/469 |
| 2151495 | 7/1985 | United Kingdom | 446/409 |

*Primary Examiner*—Robert A. Hafer
*Assistant Examiner*—D. Neal Mair
*Attorney, Agent, or Firm*—Calfee, Halter & Griswold

[57] ABSTRACT

A music box subassembly and a vehicle structure which incorporates the music box subassembly in such a way that the vehicle structure is useful both as a toy vehicle and also as a collectible music box. The vehicle structure offers selectable operating options. In one operating option, the music plays as the vehicle rolls, and in the other operating option, the vehicle "freewheels", without playing music which makes it attractive as a toy vehicle. Moreover, the vehicle structure is designed to incorporate a music box which is capable of producing rich, resonant sound of high quality, and to drive the music box with a precision designed to take advantage of the sound producing qualities of the music box. Also, the vehicle structure is designed to produce rich, resonant sound of high tonal quality music in a relatively compact package, which is attractive in both the toy and collectible art. Additionally, the vehicle structure is designed to facilitate assembly of the music box, and incorporation of the music box into a vehicle body.

18 Claims, 14 Drawing Sheets

REVERSE ROLL
FREE WHEEL
NO MUSIC

REVERSE ROLL
DOWNWARD PRESSURE
NO MUSIC

FORWARD ROLL
FREE WHEEL
NO MUSIC

FORWARD ROLL
DOWNWARD PRESSURE
PLAYS MUSIC

MUSIC BOX SUBASSEMBLY AND A VEHICLE STRUCTURE INCLUDING THE SAME

TECHNICAL FIELD

The present invention relates to a new and useful music box subassembly and to a vehicle structure with such a music box incorporated therein. The vehicle structure is designed with features which make it attractive both as a toy, and also as a collectible music box. The vehicle structure (i) has a relatively compact size, (ii) produces a rich, high quality musical sound, and (iii) is designed so that it has significant play value. Moreover, the vehicle music box subassembly is designed to enable the music box to be simply and efficiently assembled, and incorporated into the vehicle structure.

BACKGROUND

Over the years, various ways for incorporating a music box into a vehicle have been suggested. For example, in Handler, U.S. Pat. No. 2,908,997, a music box is incorporated into a toy vehicle, and an adjustable actuating mechanism is designed to actuate the music box in several different operating modes. The music box comprises an endless elastic band with plucking fingers protruding therefrom, and a comb with cantilevered reed members which are engaged by the plucking fingers and vibrated to produce musical sounds. The elastic band is entrained, under tension, about a pair of spaced shafts, one of which rotatably driven. The driven shaft has a frictional engagement with the inside of the elastic band, so that rotation of the shaft causes movement of the elastic band. The driven shaft is rotated by a driven wheel which is rotated by frictional engagement with one of the rear wheels of the vehicle.

The Handler toy vehicle has a rear wheel axle which can be moved relative to the vehicle body, to enable the toy vehicle to have three different operating modes. Specifically, a rear wheel axle is adapted to shift relative to the vehicle body between an engaged position in which the driven wheel is engaged with one of the rear wheels and frictionably driven thereby, and a disengaged position in which the driven wheel is disengaged from the rear wheels. A spring biases the rear wheel axle to a position in which the driven wheel is disengaged from the rear wheels. In one operating mode, the rear axle is clamped in a position in which the rear wheels are disengaged from the driven wheel so that the music box does not play. In that mode, the toy vehicle can "freewheel". In another operating mode, the wheel axle is clamped in a position in which the driven wheel is engaged and rotated continuously to cause continuous operation of the music box. In that operating mode, the elastic band is rotated in one direction when the toy vehicle rolls in a forward direction and in an opposite direction when the toy vehicle rolls in a reverse direction. In yet a further operating mode, the rear axle is not maintained in either an engaged or disengaged position, and the driven wheel is intermittently frictionally engaged with one of the rear wheels when downward pressure is applied to the vehicle body. Downward pressure on the rear of the vehicle body causes frictional engagement of the driven wheel with the one of the rear wheels, in order to rotate the elastic band. When the downward pressure is released, the spring retracts the rear wheel axle to a position in which the driven wheel is disengaged from the rear wheels, thereby enabling the vehicle to freewheel.

In the applicant's experience, an elastic band such as disclosed in Handler produces a relatively hollow sound in comparison to the rigid, cylindrical drum which can be found in collectible, stationary wind-up music boxes. Also, applicant assumes that the plucking fingers on the elastic band would actuate the reeds in the tonal pattern of a recognizable tune when the band rotates in one direction, but would not play a recognizable melody when the band rotates in the opposite direction. Thus, in either the continuous play or the intermittent play mode, if the toy vehicle is rolled in both forward and reverse directions, the music box will play a recognizable tune when the vehicle rolls in one direction, but will play unrecognizable music then the vehicle rolls in the other direction. If one waited to avoid the unrecognizable music, an obvious way would be by means of the device shown in U.S. Pat. No. 2,630,655. U.S. Pat. No. 2,630,655 discloses a way of making an elastic band type of music box play only in one direction, by shaping the the plucking fingers on the elastic band so that when the elastic band moves in a reverse direction, no sound is produced.

Another disclosure of a music box which can be incorporated into a toy vehicle is found in Duncan, U.S. Pat. No. 2,961,911. Duncan discloses a music box comprising a plucking disc and a comb disposed below the plucking disc. The plucking disc is rotatable about a central post. A gear profile is formed at the outer perimeter of the plucking disc and is configured to engage a pair of pinion gears disposed along the wheel axle of the toy vehicle. Both pinion gears rotate in the same direction on the wheel axle, but because they are 180° out of phase, the pinion gears tend to try to turn the gear on the plucking disc in opposite directions. A pair of springs are rotatably supported by the wheel axle. The springs are designed to engage shoulders on the backside of the pinion gears so that each spring can drive its respective pinion gear in one direction and ratchet over the shoulder when the pinion gear is rotated in the other direction. Thus, one pinion gear or the other is always driving the plucking disc in a single direction, regardless of which direction the wheel axle is turning. This leads to continuous rotation of the plucking disc in one direction regardless of whether the vehicle is rolling in a forward or reverse mode.

Applicant believes the niceties of the foregoing type of structures are offset by drawbacks. Handler's toy vehicle has various play modes, which is attractive in the toy art. However, Handler's elastic band music box produces a fairly hollow, muffled, imprecise tonal quality, in comparison to the relatively rich, resonant, accurate tonal quality which can be produced by a rigid cylindrical drum-type music box. Moreover, Handler's structure utilizes a friction drive to operate the music box, and in the applicant's experience, a friction drive would require very high precision and close tolerances to drive continuously the elastic band. Otherwise, a friction drive will have slippage, which further diminishes the tonal quality of the musical sound produced by Handler's elastic band. Also, the package size and the assembly technique for Handler's device are dictated by the fact that (i) Handler's music box components are all secured to the bottom of the body, (ii) Handler's driven wheel frictionally engages the outer perimeter of the rear wheel, and (iii) Handler's elastic band must be stretched taut to produce any kind of acceptable drive and sound.

By contrast, Duncan's toy vehicle does not have the play value of Handler's toy vehicle, but Duncan's toy vehicle produces a tune continuously because the plucking disc is always rotated in a single direction. However, applicant believes Duncan's structure is fairly complex. Moreover, a plucking disc and gear combination would have to be fairly wide to be rotated in the manner disclosed by Duncan and also support enough plucking fingers to produce the same tune that can be produced with a relatively small diameter rigid cylinder type of music box. Thus, Duncan's structure restricts the ability to miniaturize the vehicle package and yet produce a complex tune in high quality tones.

In the toy art there is a continuous demand for miniature vehicle structures that can incorporate play value. Moreover, in both the toy art and the collectible music box art, there is a continuous demand for new and useful ways of producing complex music in high quality tones by means of music boxes which can be located in compact, but attractive, housings. Still further, applicant believes it important that incorporation of a music box into a toy vehicle or a collectible type of vehicle be accomplished by means of structure which is relatively simple in construction and easily assembled into a music box which produces rich, high quality sound.

SUMMARY OF THE INVENTION

The present invention provides a vehicle structure which incorporates a music box in such a way that the vehicle structure is useful both as a toy vehicle and also as a collectible music box. The vehicle structure offers selectable operating options. In one operating option, the music plays as the vehicle rolls, and in the other operating option, the vehicle "freewheels" without playing music, which makes it attractive as a toy vehicle. Moreover, the vehicle structure is designed to incorporate a music box which is capable of producing rich, resonant sound, of high quality, and to drive the music box with a precision designed to take advantage of the sound producing qualities of the music box. Also, the vehicle structure is designed to produce rich, resonant sound of high tonal quality music in a relatively compact package, which is attractive in both the toy and collectible art. Additionally, the vehicle structure is designed to facilitate assembly of the music box, and incorporation of the music box into a vehicle body.

Accordingly, to a particularly useful aspect of the invention, the music box is incorporated into a subassembly which is inserted as a unit into a vehicle body. The subassembly is designed to place relatively modest constraints on the size and the shape of the vehicle body required to accommodate the subassembly. Thus, one aspect of the invention provides a universal music box subassembly which can be used with a vehicle body having many different forms.

According to one preferred form of the invention, the music box comprises a relatively rigid cylindrical drum having plucking fingers and a comb with reed fingers which are vibrated by the plucking fingers as the cylindrical drum rotates relative to the comb. The cylindrical drum and the comb are of the types typically found in stationary housings common to collectible music boxes containing figurines and the like. The cylindrical drum is coupled with a specially formed drive mechanism that is compact, formed of relatively few parts, and designed to efficiently and precisely drive the cylindrical drum. The drive mechanism comprises a pair of drive gears, a pair of pinion gears coupled to one of the wheel axles, and a special intermediate idler gear disposed between one pinion gear and the drive gear. The pinion gears and the idler pinion are all of the same size, and the drive gears are of the same size. The drive gears are rotated in opposite directions, and one or the other drive gear is coupled to the cylindrical drum to drive the cylindrical drum whenever the drive gear is rotating in a single selected direction. Thus, the cylindrical drum rotates in one direction only and can be intermittently coupled to the drive mechanism by depressing the vehicle axle.

In another preferred form of the vehicle structure of the present invention, a single drive gear is provided and a one way clutch is disposed between the drive gear and the cylindrical drum. The one way clutch causes the cylindrical drum to rotate whenever the drive gear is rotated in one direction, but does not rotate when the drive gear is rotated in an opposite direction. Thus, the vehicle structure will play music when the drive gear is coupled to the wheel axle and the vehicle structure rolls in one direction, but will not play music when the vehicle structure rolls in the other direction.

An additional aspect of the invention relates to structure whereby the drive gear(s) associated with the cylindrical drum can be maintained in engagement with the wheel axle by means of a specially formed linkage and a mechanical key. Specifically, the linkage is designed so that a mechanical key in the form of a toy figure, (e.g. simulating an vehicle occupant) can be combined with the vehicle and designed to hold the drive gear(s) engaged with the wheel axle. Thus, rather than depressing the body, one only need to locate the toy figure in a particular orientation in the vehicle to maintain engagement between the wheel axle and the drive gear(s).

Still further, structure is provided to enable the drive gear(s) to be engaged with drive pinion(s) on the wheel axle by simply depressing and holding depressed an actuator (e.g. a button) protruding from the body.

The vehicle structure of the invention is compact and designed to enable the music box to be readily assembled and readily incorporated into the vehicle body. This enhances the manufacturing and assembly of the vehicle of the invention.

Also, a music box subassembly is designed to be located in a small sized body. This feature is useful in enabling the vehicle to function as either a miniature toy vehicle or a miniature collectible music box.

Moreover, the vehicle structure is designed so that a universal music box subassembly can be incorporated into body of different configurations. Thus, the vehicle structure allows for versatility in the design of the body.

These and further features and advantages of the present invention will become further apparent from the following detailed description and the accompanying drawings.

DETAILED DESCRIPTION OF THE PREFERRED EMBODIMENTS

Figure 1:
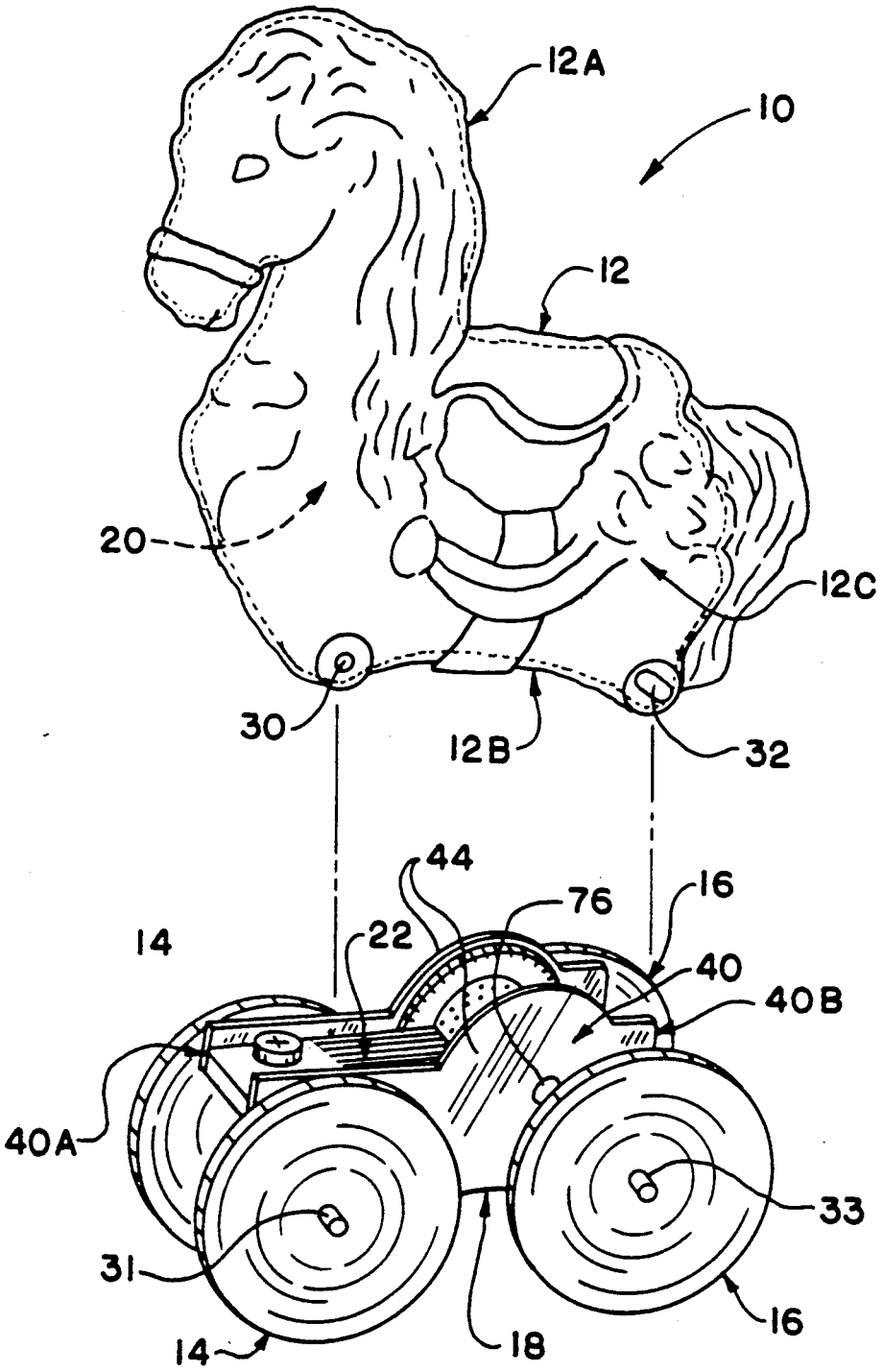
FIG. 1 is a three dimensional, exploded view of a vehicle body and a music box constructed according to the principles of this invention.

As set forth above, the present invention relates to a vehicle structure which is particularly useful in forming a toy vehicle, or forming a collectible type of music box. The vehicle structure of the invention is described below as it would be used to form a toy vehicle. However, the manner in which the principles of this invention can be adapted to form a collectible music box with a vehicle body made from porcelain, precious or semi-precious metal, or other type of material typically used in the formation of a collectible music box will be clear to those of ordinary skill of the art.

In the embodiment of FIGS. 1–6, a toy vehicle 10 includes a body 12 having a fanciful configuration. The body 12 is illustrated having the configuration of a horse, but it will be clear to those of ordinary skill in the art that the body 12 can take on numerous other forms. A pair of front wheels 14 and a pair of rear wheels 16, each supported on a respective wheel axle, support the body 12 on a surface and enable the body 12 to roll in forward and reverse directions along the surface.

A music box subassembly 18 is disposed in a cavity 20 located inside the body 12. The music box subassembly 18 includes a comb 22 with reed fingers 24, and a rotatable cylindrical drum 26 with plucking fingers 28 which engage and vibrate the reed fingers 24 as the cylindrical drum 26 rotates relative to the comb 22. According to the invention, the cylindrical drum 26 is adapted to be rotated relative to the comb 22 under certain conditions, as the toy vehicle rolls along the surface, as described more fully hereinafter.

Figure 7:
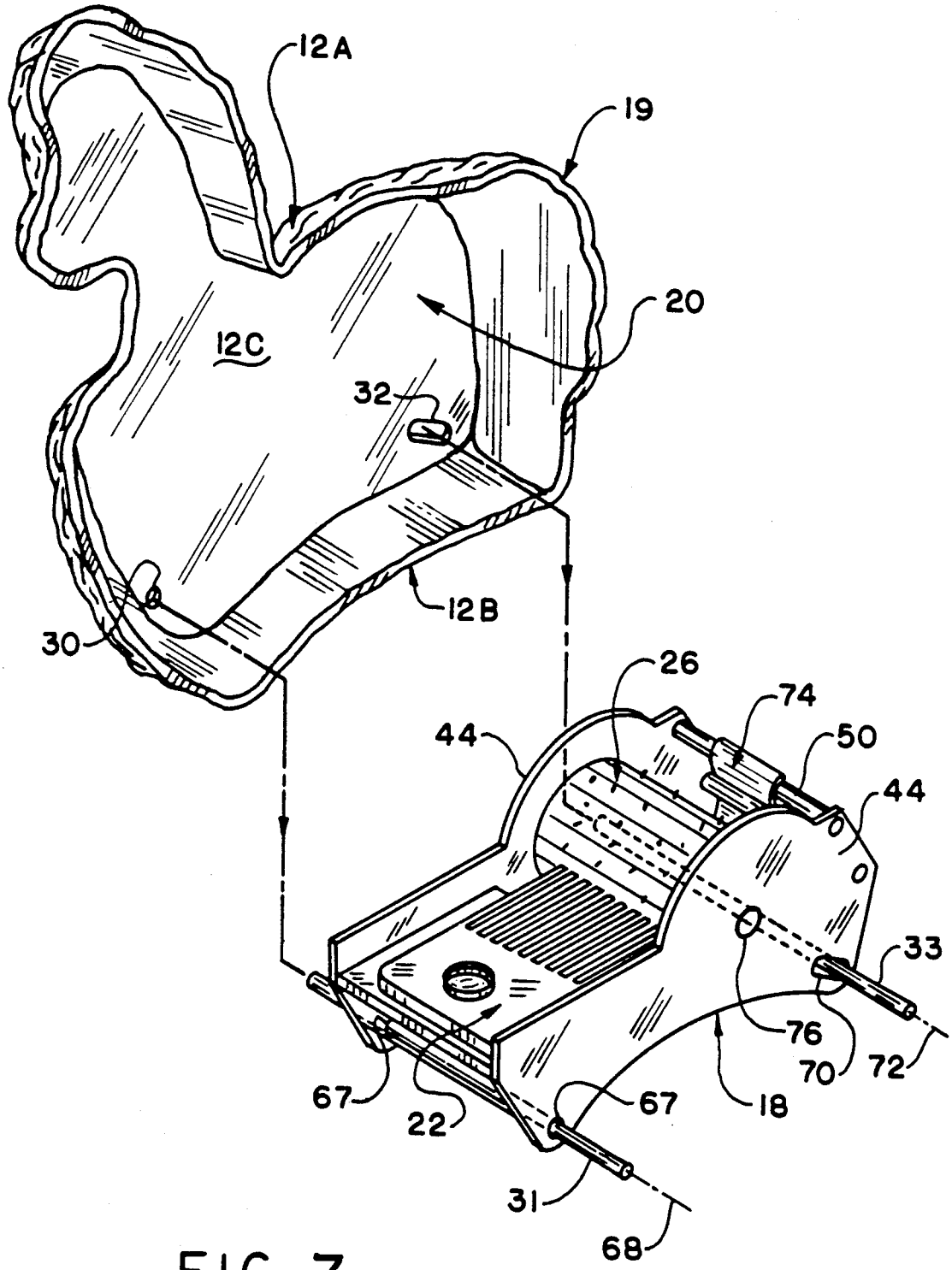
FIG. 7 is a fragmentary, exploded view of certain components of the vehicle structure, in unassembled condition.
Figure 8:
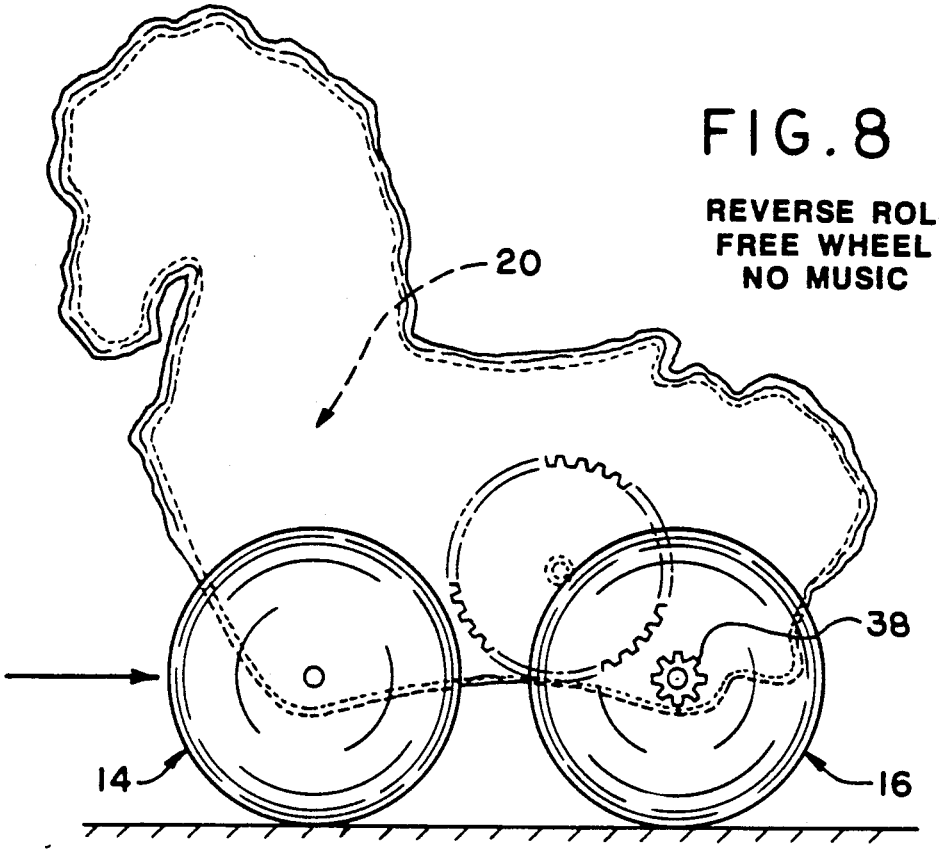
FIGS. 8–11 schematically illustrate different modes of movement of the vehicle structure of FIGS. 1–6.
Figure 9:
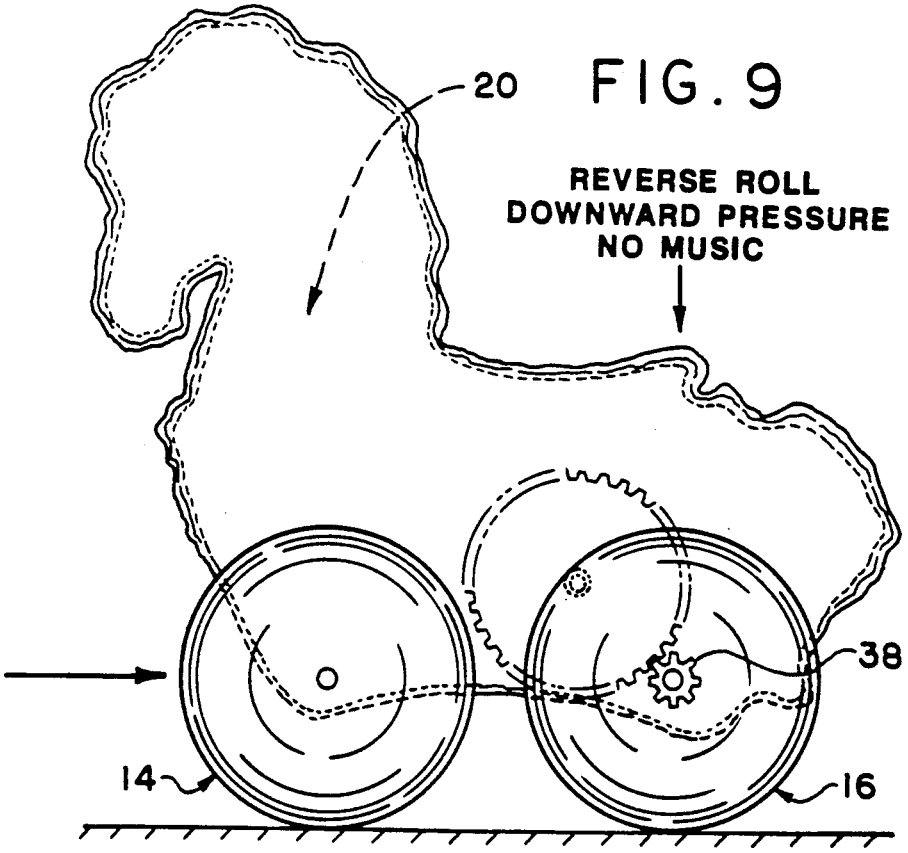
Figure 10:
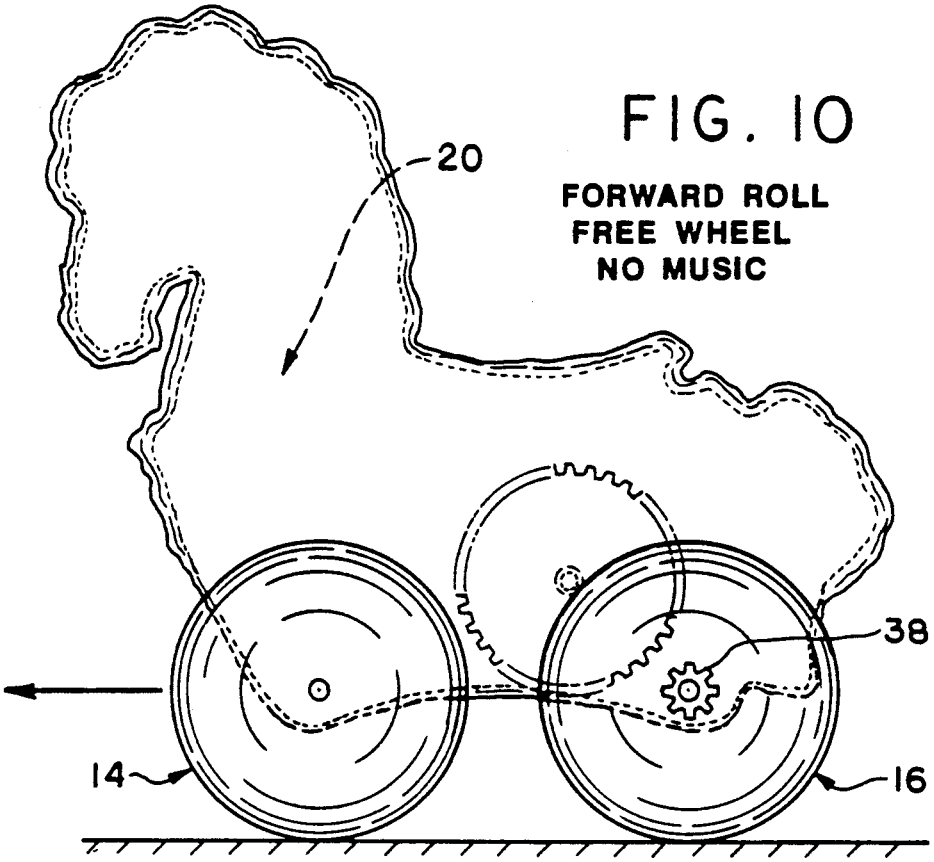
Figure 11:
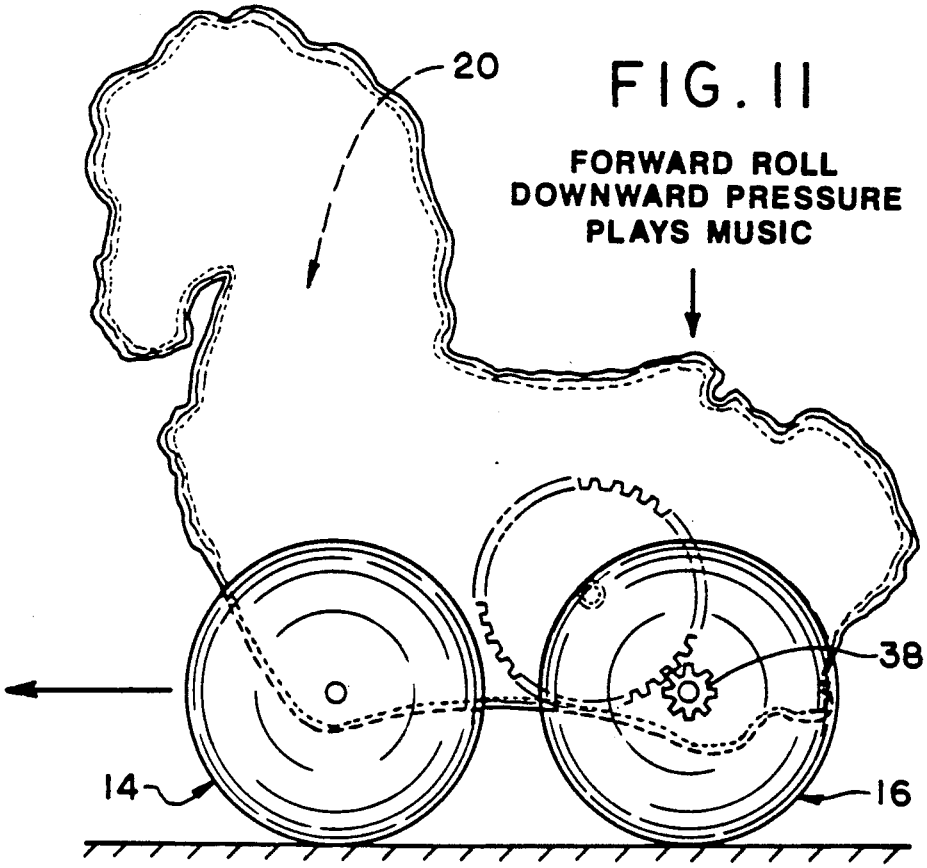

The body 12 is a hollow structure with the cavity 20 located therein. The body 12 has an exterior comprising a top portion 12A, a bottom portion 12B and opposite side portions 12C. The body 12 is formed by a pair of body sections 19 which are separately formed, and then coupled together. FIG. 7 shows the inside of one of the body sections 19. The body section 19 shown in FIG. 7 defines approximately one-half of the internal cavity 20 for receiving the music box subassembly 18. The side portion 12C of each body section 19 has a journal bearing 30 for receiving a front wheel axle 31, and an angular slot 32 for receiving a rear wheel axle 33. The angular slot 32 is designed so that when the body 12 is supported on a surface, the angular slot 32 extends at approximately 45 degrees to the surface.

The other section of the body 12 is essentially a mirror image of the body section 19 shown in FIG. 7. The two body sections are combined to form a substantially closed, hollow body 12 with the internal cavity 18 located on the inside of the the body 12. Then the body 12 is assembled, it will have opposed journal bearings 30 for receiving the front wheel axle 31 and opposed angular slots 32 for receiving the rear wheel axle 33.

The front wheel axle 31 comprises a relatively straight shaft. The rear wheel axle has a pinion gear 38 fixed thereon. The pinion gear 38 is slightly larger than the rear wheel axle 33, and surrounds the rear wheel axle 33. The pinion gear 38 is preferably molded of a plastic such as nylon. The pinion gear 38 is designed to initiate rotation of the cylindrical drum of the music box, as described more fully hereinafter.

Figure 2:
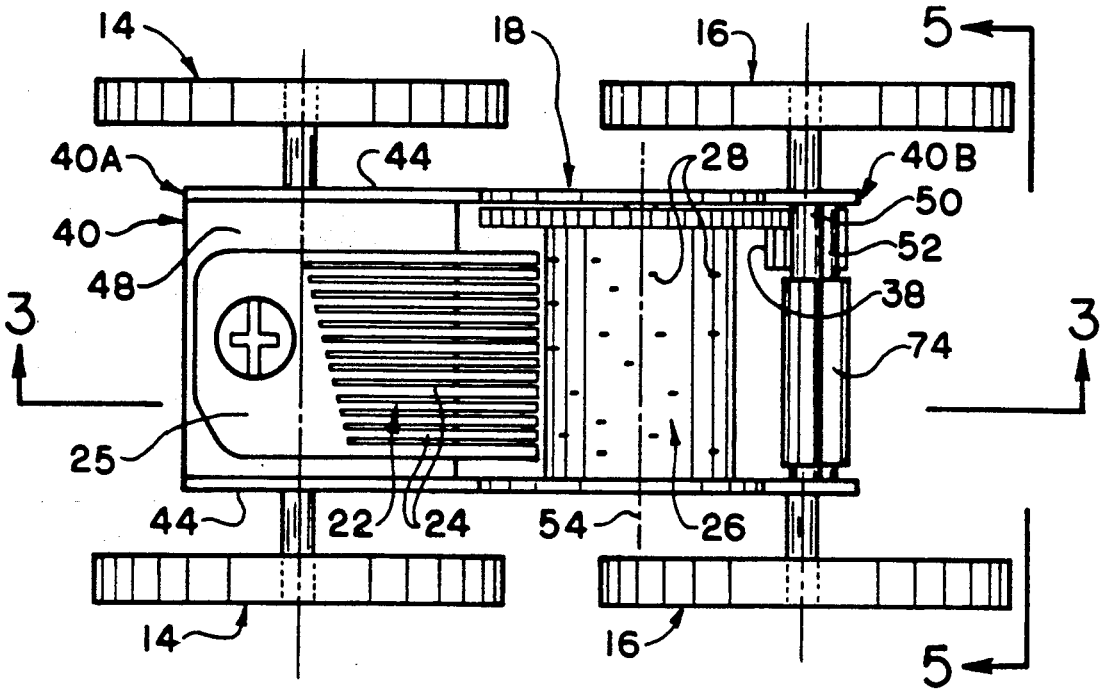
FIG. 2 is a top plan view of the music box structure of FIG. 1.
Figure 3:
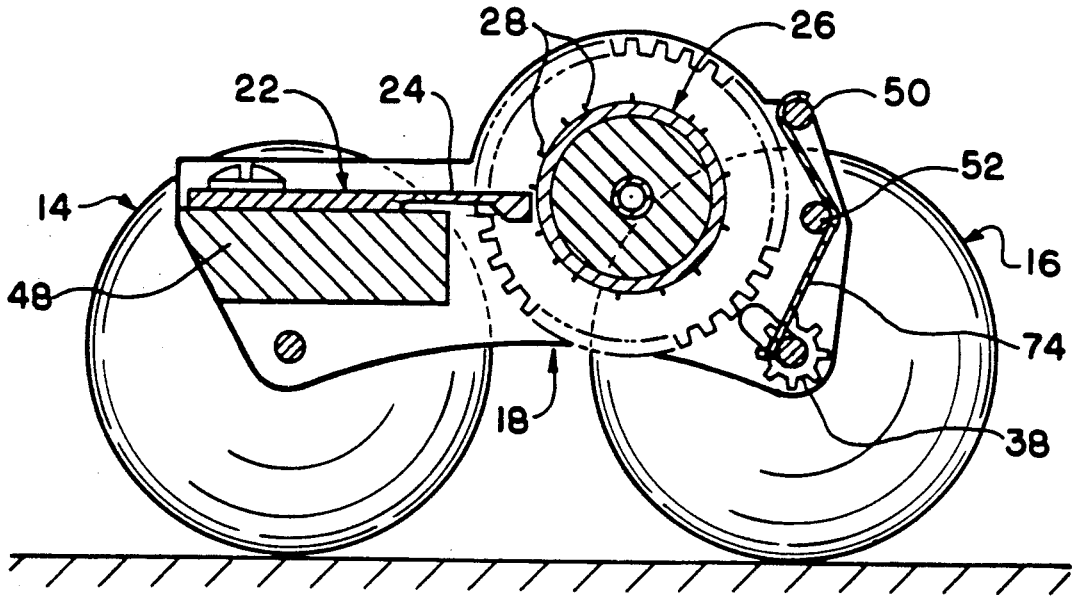
FIG. 3 is a sectional view of the music box structure of FIG. 2, taken from the direction 3—3, and showing the music box in a disengaged position.
Figure 4:
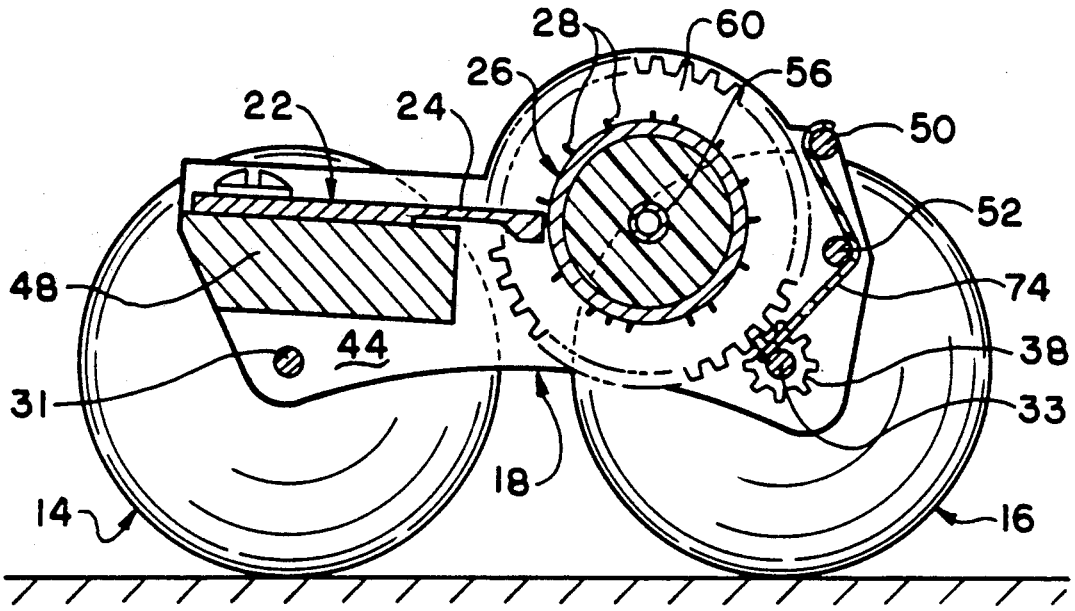
FIG. 4 is a sectional view similar to FIG. 3, but showing the music box in an engaged position.
Figure 5:
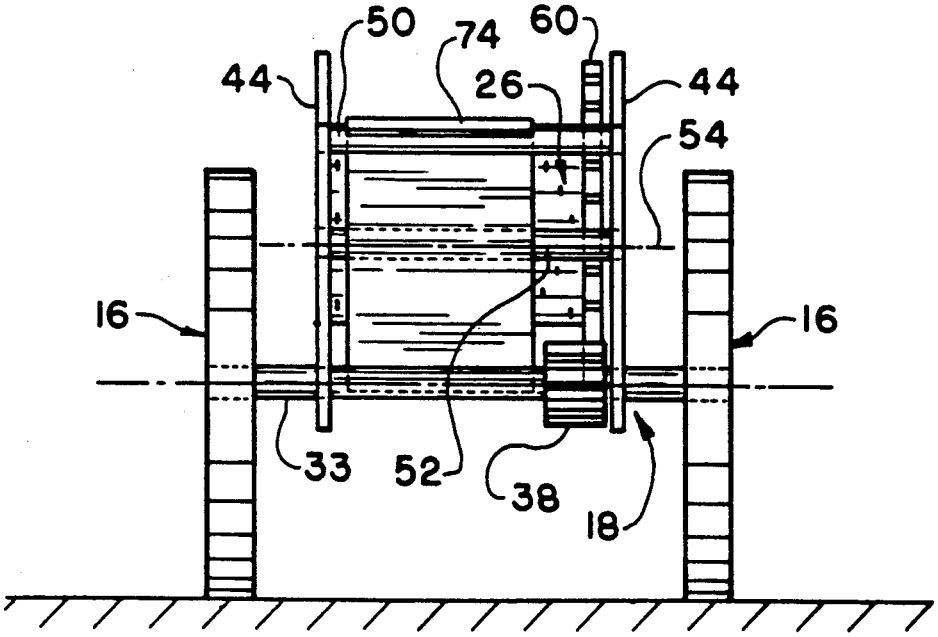
FIG. 5 is a rear elevational view of the music box structure of FIG. 2, taken from the direction 5—5.
Figure 6:
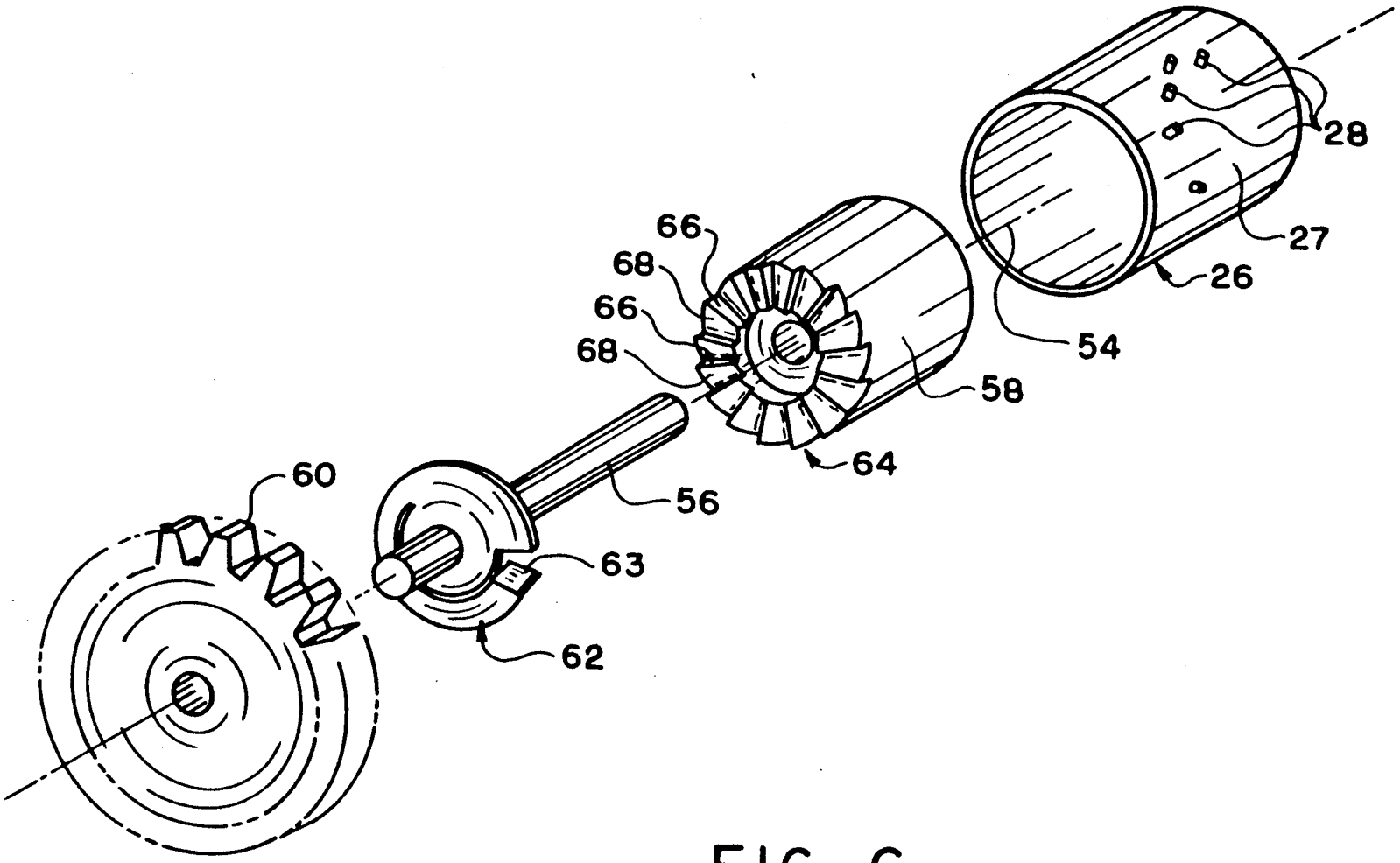
FIG. 6 is an exploded view of certain components of the music box in the embodiment of FIG. 1.

The music box subassembly 18 comprises a frame 40 with a front end 40A and a rear end 40B. The frame 40 consists of a pair of planar, spaced apart side frame members 44, and a cross-frame which extends between the side frame members 44. The side frame members 44 are made of metal, plastic or other suitable material. The cross-frame consists of a single member 48 near the front end 40A of the frame, and a pair of spaced apart bars 50, 52 near the rear end 40B of the frame 40. The music generating device, comprising the comb 22 and the cylindrical drum 26, is supported by the frame 40 and located between the side frame members 44. The metal comb 22 has vibrating reed fingers 24 extending away from a base 25. The cylindrical drum 26 is relatively rigid, formed of metal, and has metal plucking fingers 28 extending away from a metal cylinder 27 (FIG. 6). The base 25 of the comb 22 is secured to the cross-frame member 48 at the front end of the frame with the reed fingers 24 extending toward the cylindrical drum 26. As seen in FIG. 2, the reed fingers 24 are of different lengths, to produce different musical notes when struck by the plucking fingers 28. Moreover, the reed fingers 24 are spaced above the crossframe member 48, so that the reed fingers 24 can vibrate with rich resonant musical tones. The cylindrical drum 26 is rotatable about a central axis 54 thereof. As the cylindrical drum 26 rotates, the ends of the plucking fingers 28 strike the reed fingers 24 to vibrate the reed fingers and to generate musical tones therefrom. The plucking fingers 28 are arranged to play a melody when the cylindrical drum 26 rotates in one direction about its central axis 54.

A central axle 56 is journaled in the side frame members. An internal cylinder 58 is rotatably supported on the central axle 56 and the internal cylinder 58 is fixed to the inside of the cylindrical drum 26. A drive gear 60 is fixed to the central axle 56 so as to rotate therewith. A spring washer 62 formed of spring steel, is fixed to the central axle 56 and rotates with the drive gear 60 and the central axle 56. The spring washer 62 has an actuating portion 63 adapted to engage a specially contoured face 64 at one end of the internal cylinder 58 to form a one way clutch therebetween. Specifically, the face 64 of the internal cylinder 58 has one or more shoulders 66, and inclined ramps 68 adjacent the shoulders 66. The inclined ramps 68 and the shoulders 66 are so disposed so that when the drive gear 60, the spring washer 62 and the central axle 56 are turning in one direction, the spring engages one of the shoulders 66 and drives the cylinder 58 and the cylindrical drum 26 in that same direction. However, when the drive gear 60 is rotated in the opposite direction, the actuating portion 63 of the spring washer 62 ratchets over the inclined ramps 68, and the cylinder 58 and cylindrical drum 26 are not driven. Thus a one-way clutch is formed between the drive gear 60 and the cylindrical drum 26.

In the embodiment of FIGS. 1–6, the one-way clutch is important for several reasons. When the rigid, metal, cylindrical drum 26 is rotated in one direction, a rich, high quality, recognizable melody is played. However, if the cylindrical drum 26 is rotated in a reverse direction, the plucking fingers 28 and the reed fingers 24 may become engaged in a manner which causes undue stress between such fingers, and may even cause some of the plucking fingers or the reed fingers to break. Moreover, if the cylindrical drum 26 is rotated in a reverse direction, an unrecognizable array of sounds will result. Thus, in the embodiment of FIGS. 1–6, it is important that the cylindrical drum 26 be adapted to rotate in one direction.

In order to cause the music box to operate, the drive gear 60 must be rotated about the central axis 54. In order to cause the drive gear 60 to rotate about the central axis 54, the drive gear 60 must be en with the pinion gear 38 on the rear wheel axle 33. According to the invention, the toy vehicle 10 can be selectively placed in a condition in which the drive gear 60 can be selectively engaged or disengaged from the pinion gear 38 along the rear wheel axle 33. When the drive gear 60 is disengaged from the pinion 38, the vehicle can free wheel. When the drive gear 60 is engaged with the pinion 38, the drive gear 60 is rotated by the pinion 38, and the cylindrical drum 26 can rotate in one direction to play the melody associated with the music box.

In the embodiment of FIG. 1–7, the frame 40 has aligned journal openings 67 in the side frame members 44 (see FIG. 7). The journal openings 66 rotatably support the front wheel axle 31. Those journal openings 67 are adapted to be aligned with the journal openings 30 in the body 12 when the music box subassembly 18 is disposed in the body 12. The journal openings 67 support the front wheel axle 31 for rotation about its central axis 68. They also allow the frame 40 and the body 12 to pivot about the central axis 68 of the front wheel axle 31, but do not allow the front wheel axle 31, to shift transversely relative to its central axis 68. The frame 40 also has aligned angular slots 70 in the two side frame members 44. Those angular slots 70 are adapted to receive the rear wheel axle 33 in a manner that allows rotation of the rear wheel axle about its central axis 72, and also allow the rear wheel axle 33 to shift transverse to its central axis 72. The angular slots 70 are aligned with the angular slots 32 in the body 12 so that the rear wheel axle 33 can shift concurrently relative to the frame 40 and the body 12.

Also, in the embodiment of FIGS. 1–7, the rear wheel axle 38 shift in the angular slots 70, 32 in the frame 40 and the body 12, respectively, to cause drive gear 60 to engage pinion 38. A biasing spring 74 is hooked (and deformed elastically) about the two spaced apart frame members 50, 52 and acts against the rear wheel axle 33, to bias the rear wheel axle 33 to an orientation (FIG. 3) in which the drive gear 60 is disengaged from the pinion gear 38 on the rear wheel axle 33. When downward pressure is applied to the rear end of the frame 40 and body 12, the rear wheel axle 33 shifts upward in the angular slots, and the drive gear 60 is shifted to an orientation (FIG. 4) in which it engages the pinion 38 and is rotatably driven thereby. When the drive gear 60 is rotatably driven in the one direction, the spring washer 62 engages the internal cylinder 58 and causes internal cylinder 58 and the cylindrical drum 26 fixed thereto to rotate with the drive gear 60 in that one direction. When pressure is relaxed on the rear wheel axle 33, the biasing spring 74 moves the rear wheel axle 33 to an orientation in which the drive gear 60 is disengaged from the pinion 38. In that condition, the vehicle can free wheel.

To assemble the toy vehicle 40, the body sections 19, which are preferably made of plastic, are formed (preferably molded) into their respective configurations. The music box subassembly 18 is formed outside the body 12. Specifically, the internal cylinder 58 is fixed to the cylindrical drum 26. The drive gear 60 and the spring washer 62 are fixed to the central axle 56, and the central axle 56 is inserted into a opening in the internal cylinder 58. The central axle 56 with the foregoing elements thereon is inserted into journal openings 76 in the side frame members 44 (See FIG. 7). The journal openings 76 support the central axle 56 for rotation about the central axis 54. The comb 22 is attached to the cross-frame member, 48.

The front and rear wheel axles 31, 33 and the biasing spring 74 are then attached to the music box subassembly. The front wheel axle 31 is disposed in the journal openings 67 in the side frame members 44, and the rear wheel axle 33 is disposed in the angular slots 70 in the vehicle 40. The biasing spring 74 is flexed to bend it around the two fixed frame members 50, 52 and the spring bent back to engage the rear wheel axle 33.

Next, the music box subassembly 18, with the attached wheel axles and biasing spring, is disposed as a unit into the portion of cavity 20 formed in one of the body sections 19. Both wheel axles 31, 33 are disposed in their respective aligned slots journal bearings or slots 30, 32 in the body 12 and the music box sub-assembly 18 is then properly located in the part of the cavity 20 in the one body section 19. Thereafter, the other body section 19 is coupled to the first body section 19 with the journal bearing 30 in the body section receiving the front wheel axle 31 and the slot 32 in the body section receiving the rear wheel axle 33. The body sections 19 are then coupled together by means known in the art (e.g., adhesive, sonic welding, etc.) Finally, the wheels 14, 16 are attached to the front and rear wheel axles, respectively, to complete the structure of the toy vehicle.

The foregoing structure and assembly process is designed to produce a compact vehicle structure which is efficient to assemble. The drive gear 60 is adapted to engage a pinion 38 which is significantly smaller than any of the wheels 14, 16. The angular slots 70, 32 in the frame 40 and in the body 12, and the relatively small size pinion 38, allow the music box subassembly 18 to be located relatively low in the body 12 and between the wheel axles 31, 33. Locating the music box subassembly in that manner enables the height of the vehicle structure to be relatively small. Also, the use of the cylindrical drum 26, and the location of the drive elements within, or closely adjacent to the cylindrical drum, and along the central axle 56 which supports the cylindrical drum 26, means that the width of the music box subassembly can be kept relatively small. All of the foregoing structure contributes to a music box and body which is relatively compact, and such a concept is important since miniaturization is in demand in both the toy art and in the collectible music box art. Moreover, the structure is relatively efficient to assemble, because the music box subassembly and the wheel axles can all be preassembled outside the body 12 and then simply inserted into the two body halves.

Besides the ease of assembly and compactness of the structure, the toy vehicle of FIGS. 1-6 is designed to have significant play value which is important in the toy art. Specifically, referring to FIGS. 8-11, the toy vehicle can free wheel if the body 12 is not depressed, or it will play music if the body is depressed and the wheels roll in one direction (i.e. a forward direction). Such features make the vehicle attractive as a toy as well as a collectible type of music box.

Figure 12:
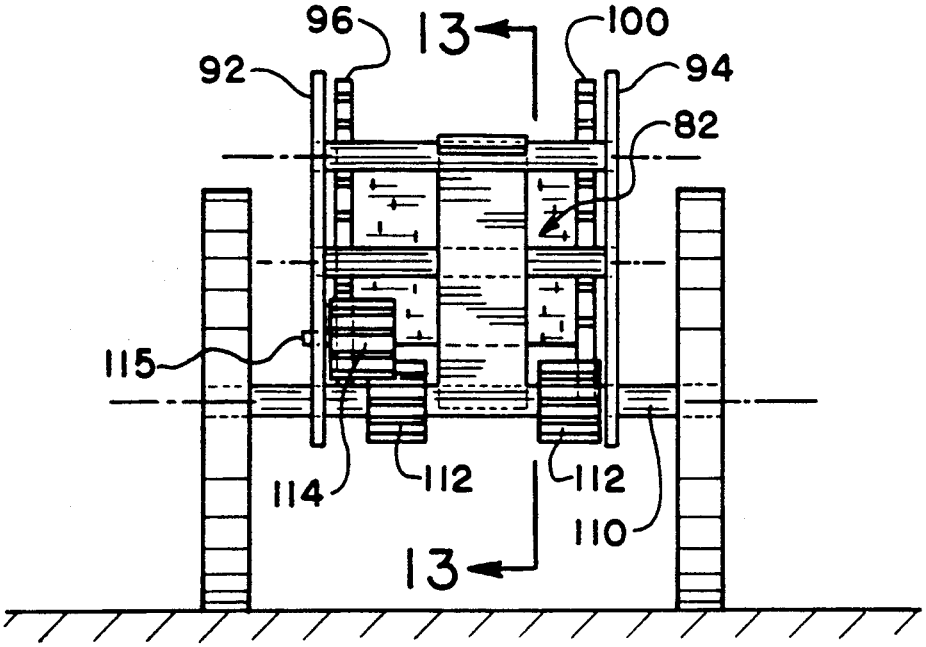
FIG. 12 is a rear elevational view of a music box according to a modified form of the invention.
Figure 13:
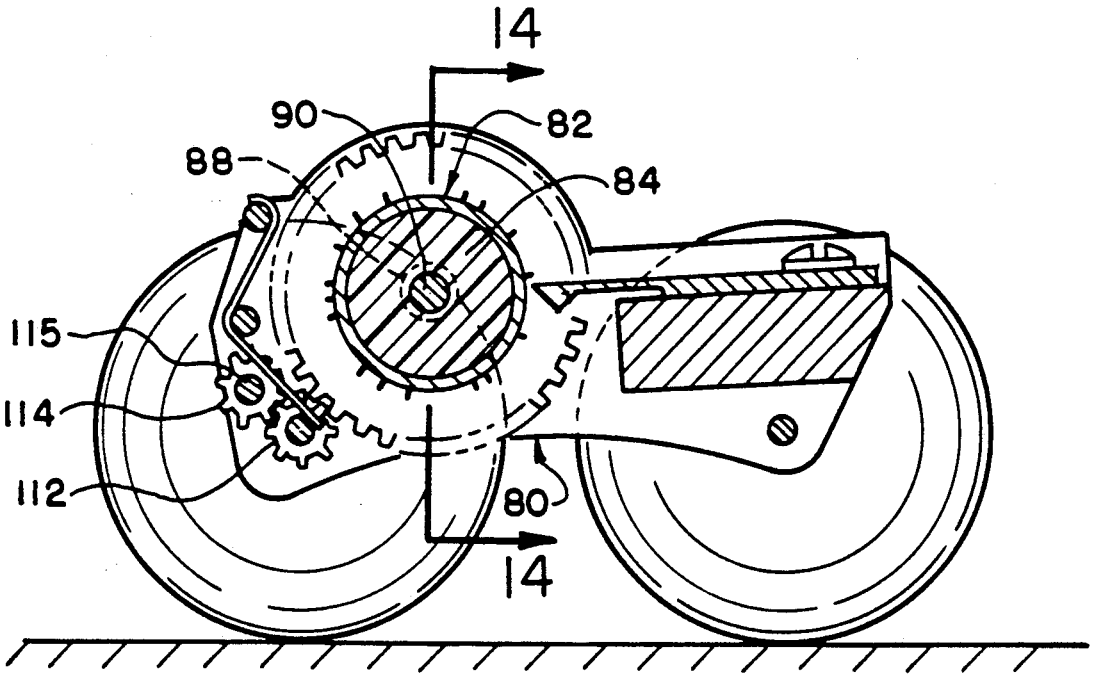
FIG. 13 is a sectional view of the music box of FIG. 12, taken from the direction 13—13.
Figure 14:
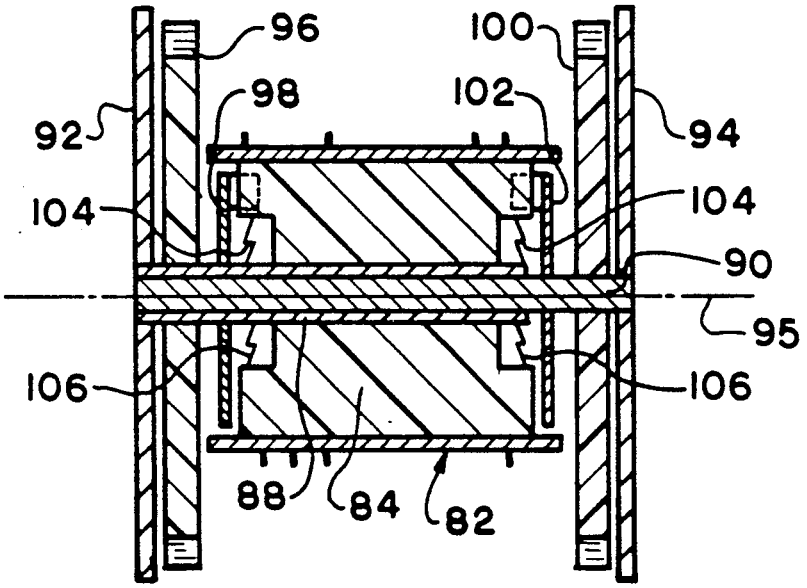
FIG. 14 is a sectional view of the music box of FIG. 13, taken from the direction 14—14, with portions omitted.

FIGS. 12-14 show an alternative form of music box subassembly 80, and an alternative drive therefor. The music box subassembly 80 has all of the elements shown in the embodiment of FIGS. 1-7, and has additional elements designed so that whenever the body is depressed, a cylindrical drum 82, similar to the cylindrical drum of the previous embodiment, will play continuously in one direction, regardless of which way the vehicle is rolling. In the embodiment of FIGS. 12-14, the cylindrical drum 82 is fixed to an internal cylinder 84. The internal cylinder 84 is rotatably supported on a two-part axle. Specifically, the axle comprises a pair of axle parts, including a pin 90 and a sleeve 88 surrounding a portion of pin 90 and rotatably supported thereon. Thus, the sleeve 88 and the pin 90 can rotate relative to each other. The internal cylinder 84 is rotatably supported on the sleeve 88. The sleeve 88 is rotatably journaled in one side frame member 92, and the pin 90 is rotatably journaled in an opposite frame member 94. Thus, both the sleeve 88 and the pin 90 can rotate relative to each other about a common central axis 95. The central axis 95 coincides with the central axis of the cylindrical drum 82.

A drive gear 96 and a spring washer 98 are fixed to the sleeve 88. Another drive gear 100 and spring washer 102 are fixed to the pin 90. The drive gears 96, 100 and spring washers 98, 102 are the same size. The internal cylinder 84 has shoulders 104 and inclined ramps 106 on both faces 108, 110 of the internal cylinder 84. However, the shoulders and the inclined ramps are designed such that each drive gear 96, 102 can only rotate the internal cylinder 82 in one direction. However, the drive gears 96, 100 can rotate simultaneously in opposite directions to each other because the two part axle has parts 88, 90 that can rotate relative to each other about axis 95.

Figure 15:
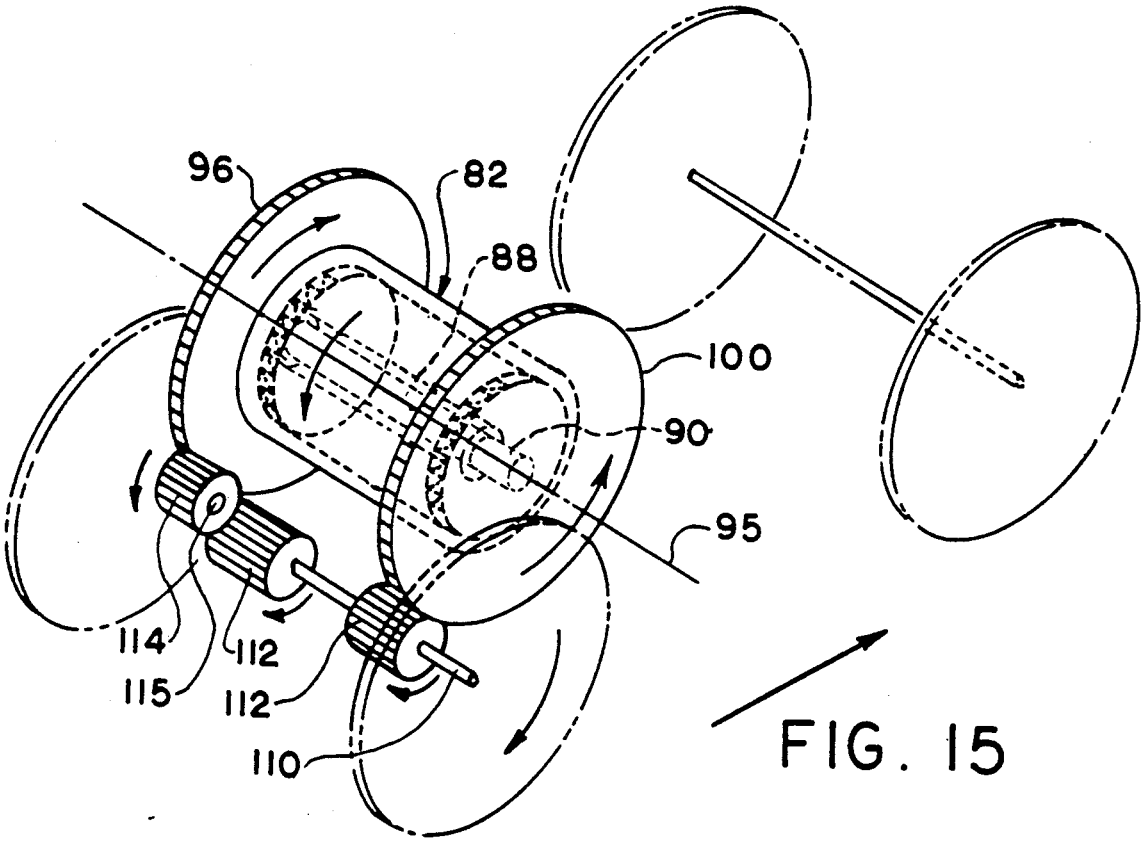
FIGS. 15 and 16 are schematic, three dimensional views of components of the music box structure of FIGS. 12–14, and illustrating the different modes of operation of the music box.
Figure 16:
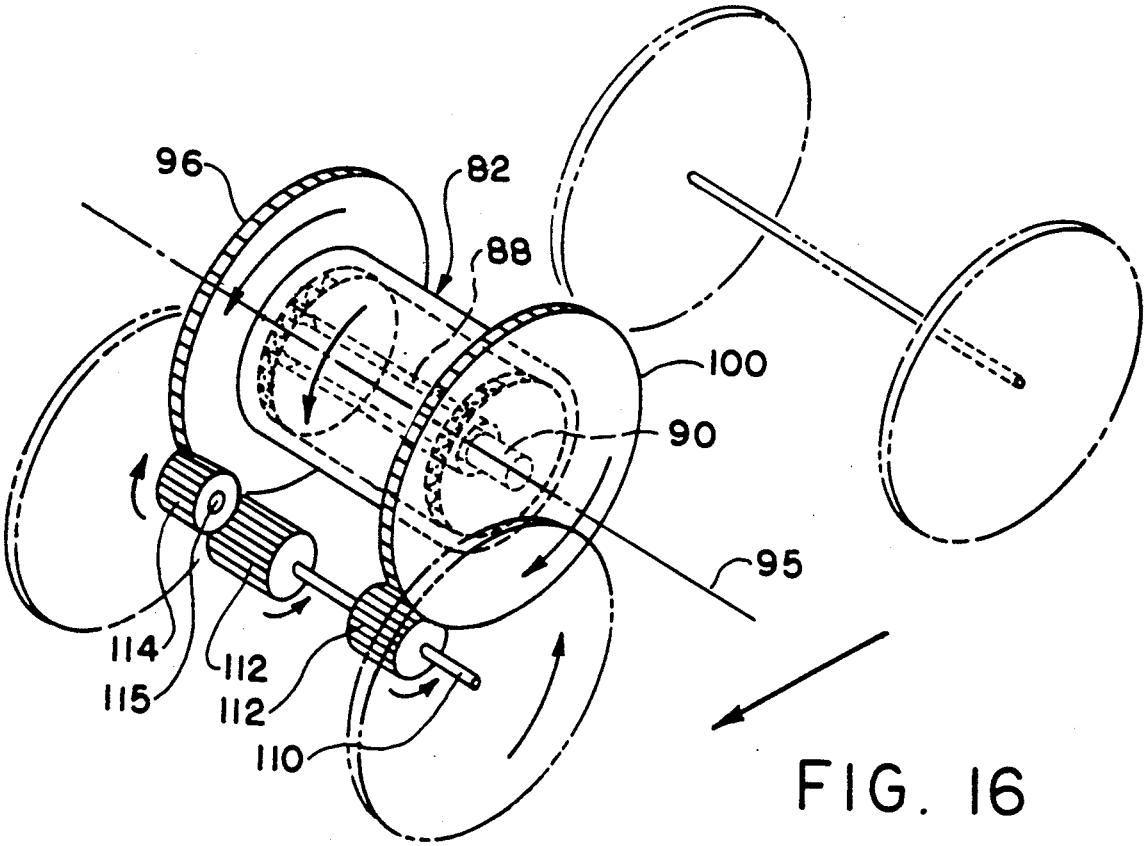

A rear wheel axle 110 has two pinions 112 of the same size fixed thereto. Moreover, an intermediate idler pinion 114 is supported rotatably supported on a shaft 115 fixed to the frame member 92 and is located between one of the pinions 112 and its associated drive gear. The idler pinion 114 is the same size as the pinions 112 on the rear wheel axle 110. Thus, when the rear wheel axle 110 rotates in one direction, both drive pinions 112 rotate in that same direction with the rear wheel axle. However, the drive gears 96, 100 rotate in opposite directions, because the intermediate idler pinion 114 reverses the direction of rotation of one drive gear, and the two part axle allows simultaneous rotation of the drive gears 96, 100 and the respective parts of the axle in opposite directions about the central axis 95. Therefore, when the body and the frame are depressed, and the wheels roll, regardless of which direction in which the rear wheel rolls, one drive gear or the other will drive the cylindrical drum in one direction (see FIG. 15). If the wheels roll in the reverse direction, the other drive gear will engage the cylindrical drum and drive it in the same first direction (see FIG. 16). Thus, regardless of which way the vehicle rolls, the music box will continuously play in one direction.

Assembly of the music box of FIGS. 12-14 with the body is accomplished in the same way as with the embodiment of FIGS. 1-7. The front and rear wheel axles and a biasing spring are assembled with the music box subassembly outside of the body, the music box subassembly and the wheel axles are inserted into journal openings and angular slots in one body section, and the other body section is coupled with the wheel axles and the first body section to complete the vehicle structure.

Figure 17:
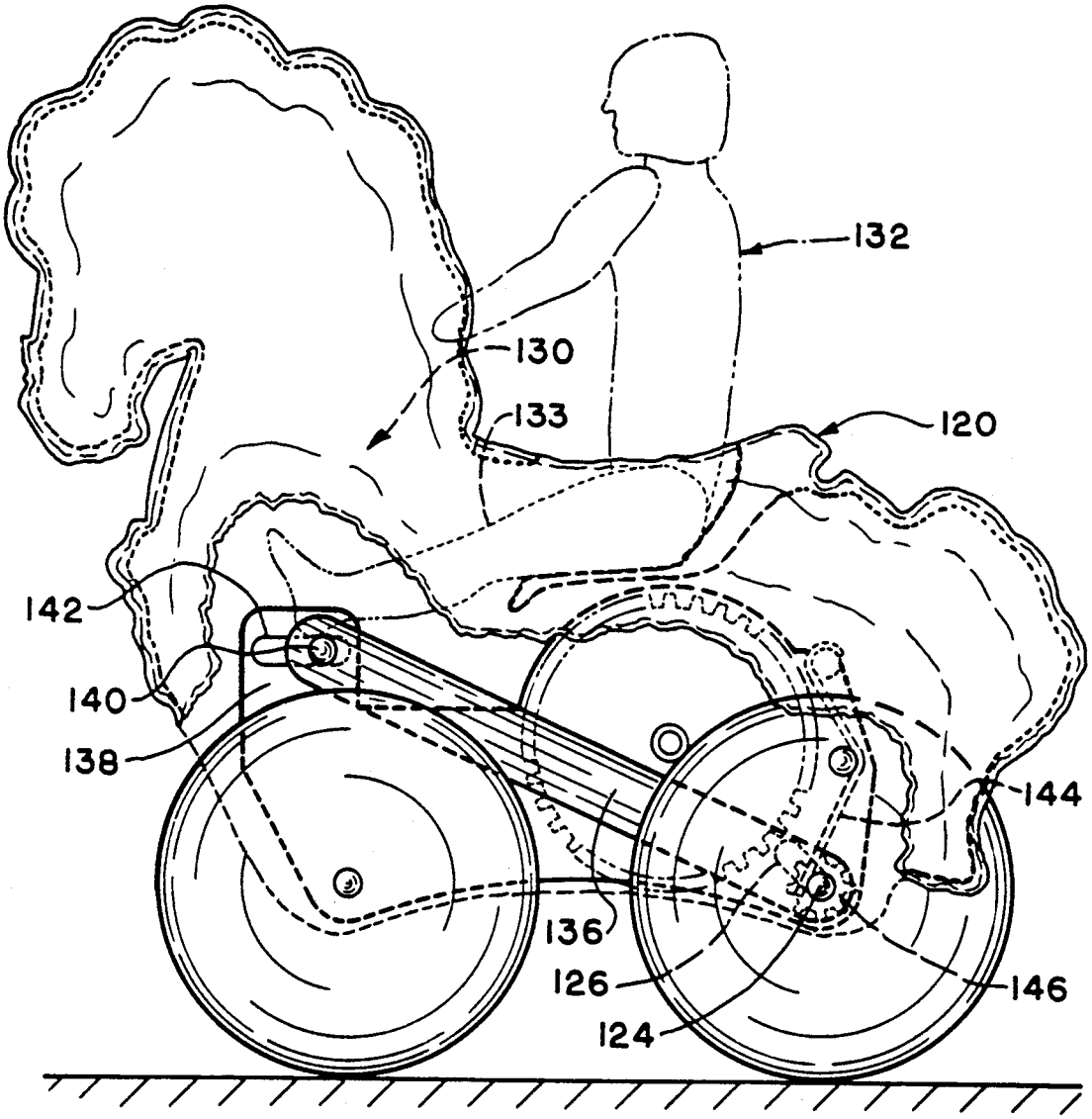
FIGS. 17 and 18 are schematic, side views of a vehicle structure according to another modified form of the invention.
Figure 18:
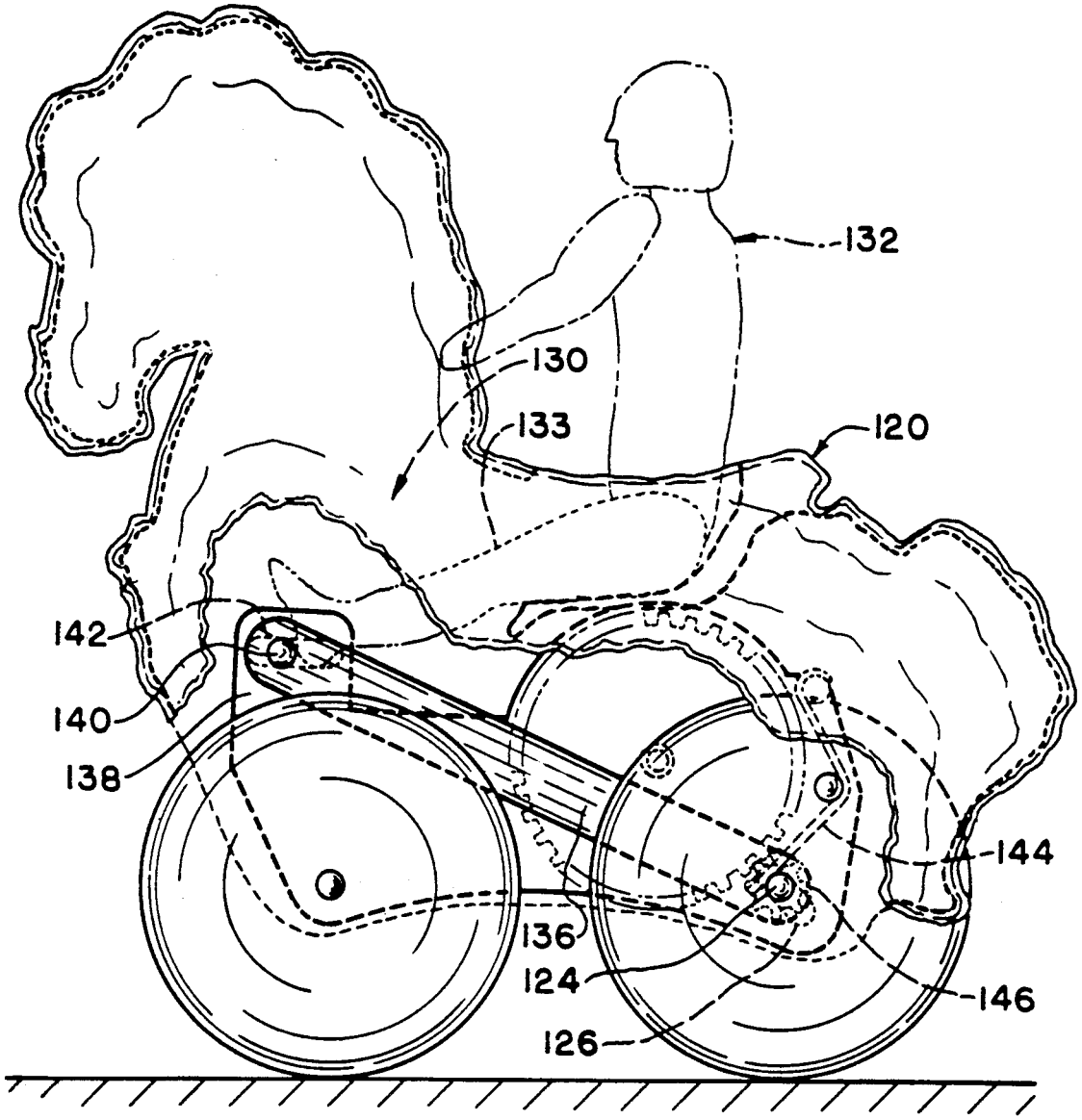

FIGS. 17, 18 show yet an additional concept for a toy vehicle with a music box according to the present invention. The music box can be generally configured as shown in either of FIGS. 1-7 or 12-14, and an additional device provided for shifting the rear wheel axle relative to the drive gear(s) associated with the cylindrical drum. According to the embodiment of FIGS. 17, 18, a linkage is provided for shifting the rear wheel axle 124 in its angular slot 126, and a mechanical key is inserted into the internal cavity 130 of the body 120 to shift the wheel axle 124 to an engaged position and to hold the rear wheel axle 124 in an engaged position. Moreover, the mechanical key can comprise part of a toy figurine 132 which can be coupled with the body 120. Thus, if the body has the configuration of a horse, for example, the mechanical key can be formed by the legs 133 of the toy FIG. 132 which can be inserted into an opening (not shown) in the saddle of the horse.

In the device of FIGS. 17, 18, the linkage comprises a rod 136 coupled to the rear wheel axle 124 and extending along one of the side frame members 138 to a location proximate to the opening through which the mechanical key 132 is inserted into the cavity 130. The rod 136 extends along the outside of the side frame member 138. The rod 136 has a pin 140 extending transverse to the rod 136 and through an additional slot 142 in the frame member 138. The pin 140 is designed so it can be shifted to a position and held in the position by locating the legs 133 of the FIG. 132 in a particular orientation relative to the pin 140. For example, the pin 140 could be located so that the legs 133 of FIG. 132 can rest above the pin 140 and thereby allow the vehicle to completely free wheel. Or, the legs 133 of the figure 132 could be located so that the legs 133 can engage the pin 140 and shift and hold the pin 140 in the position shown in figure 18. In that position, the rod 136 drags the rear wheel axle 124 against the bias of spring 144 and to a position in which a pinion (or pinions) 146 on the rear wheel axle 124 engage and cause rotation of the drive gear (or drive gears) on A the music box subassembly otherwise similar to one of the embodiments of FIGS. 1-6 or 12-14. The vehicle plays music as it rolls because the cylindrical drum of the music box will be rotated by the drive gear(s).

Figure 19:
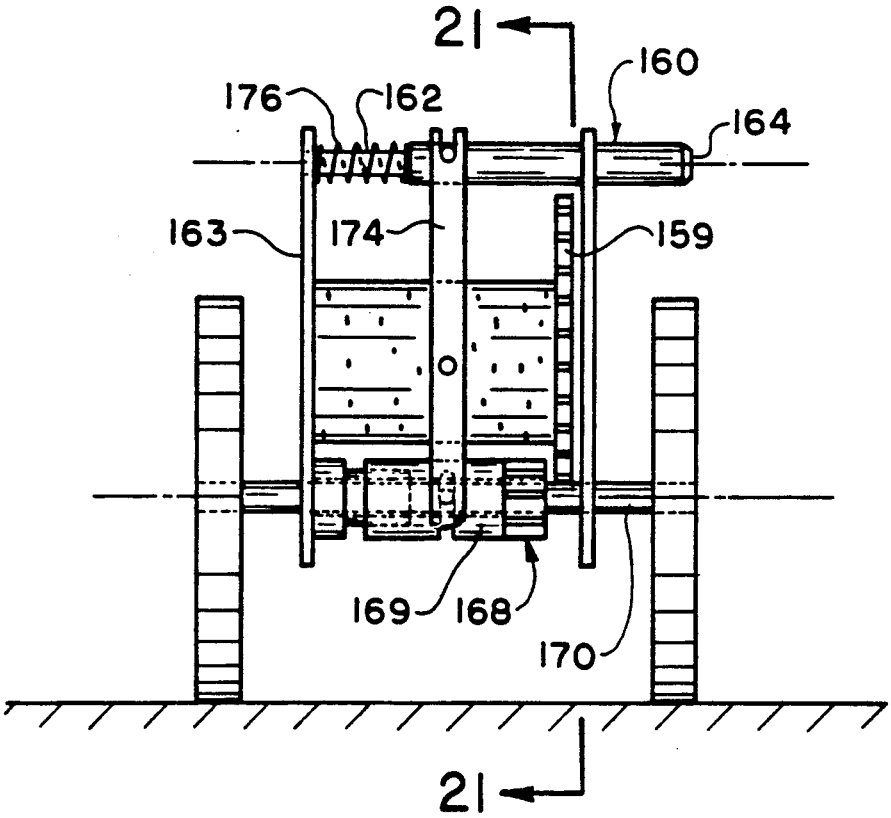
FIGS. 19 and 20 are rear, elevational views of a music box according to another modified form of the invention, showing the music generating device and the selective drive therefor in their extreme positions.
Figure 20:
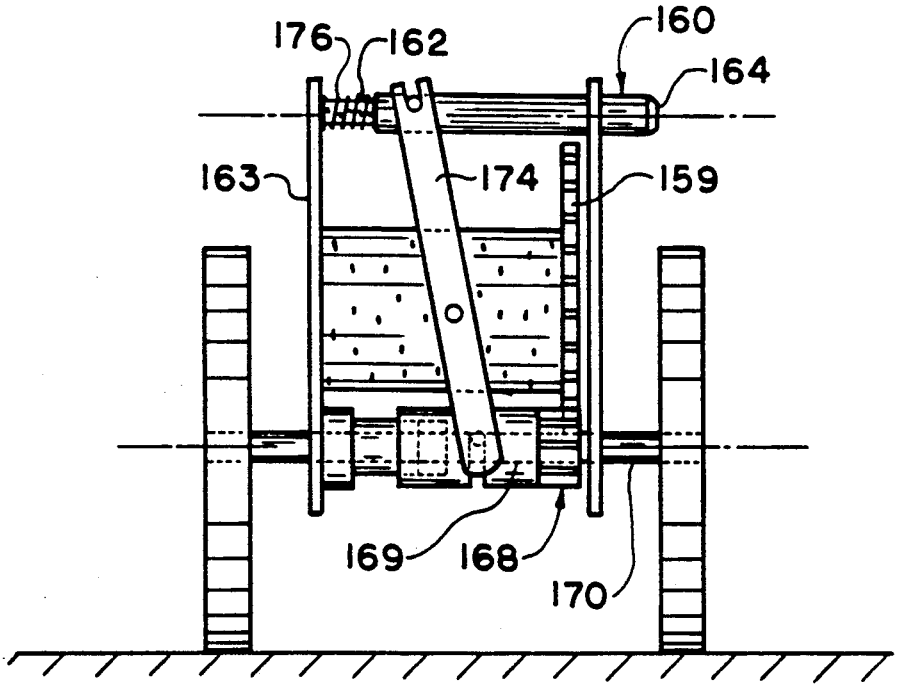
Figure 21:
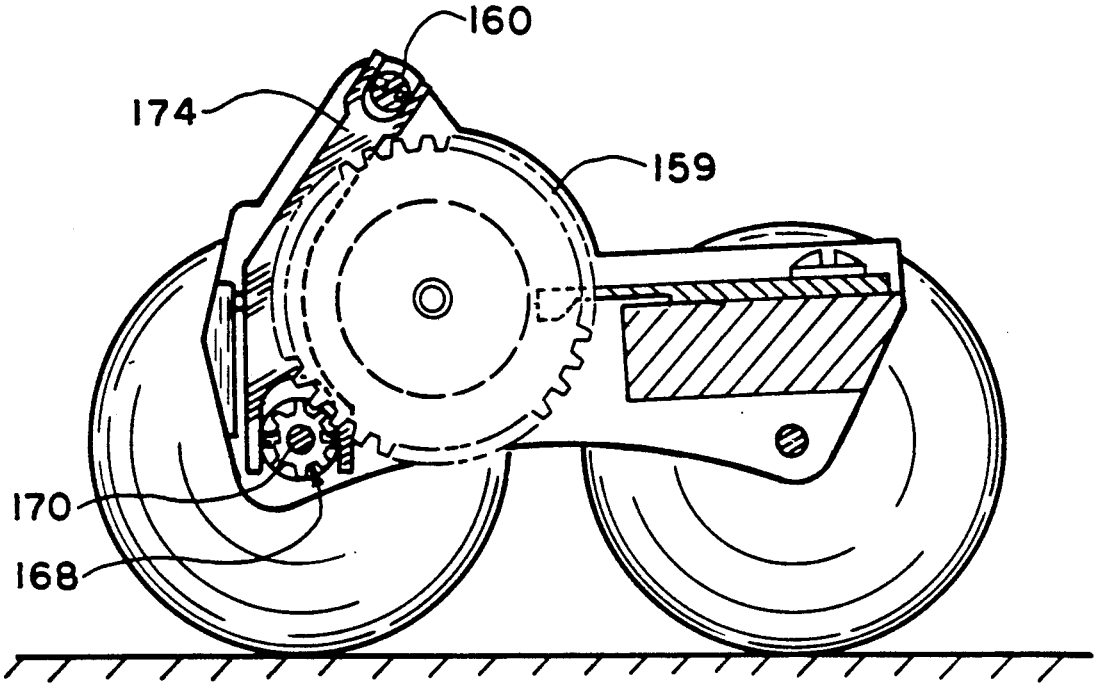
FIG. 21 is a sectional view of the music box of FIG. 19, taken from the direction 21—21.

Still another form of the invention is shown in figures 19-21. In those figures, a cylindrical drum is adapted to be rotated in one direction by structure similar to that shown in FIG. 6. An actuating mechanism for rotating a drive gear 159 consists of a sleeve 160 slidable on a shaft 162. The shaft 162 is fixed to a side frame member 163 and is biased by a spring 176 to a position in which an end 164 of the sleeve 160 protrudes from the body. A pinion 168 is connected to sleeve 169 which can slide along a rear wheel axle 170 to move pinion 168 into and out of engagement with the drive gear 159. A rod 174 is pivotally and slidably coupled with the sleeve 160 and the sleeve 169. The sleeve 160 is depressed when it is desired to hold the music box engaged. When the sleeve 160 is depressed, the rod 174 shifts the sleeve 169 and pinion 168 along the rear wheel axle 170 to cause the pinion 168 to engage the drive gear 159 (See FIG. 20). When the sleeve 160 is released, a biasing spring 176 returns the sleeve 160 to its original position.

Thus, according to the invention, there is disclosed a relatively compact size music box subassembly which can produce resonant sounds of high tonal quality, and when incorporated into a toy vehicle produces a compact toy vehicle which has various play modes and which also produces resonant sounds of, high tonal quality. With the foregoing disclosure in mind, it is believed that various obvious modifications of this concept will become further apparent to those of ordinary skill in the art.

I claim:

1. A vehicle structure comprising a body with an internal cavity, a plurality of wheels connected with said body and adapted to enable said body portion to roll in forward and reverse directions along a surface, and a music generating device disposed in said internal cavity of said body;

said body having a fanciful external configuration;

said music generating device including a relatively rigid cylindrical member which is rotatable about a central axis thereof to enable said music generating device to generate music, and a first drive device which is rotatable about said central axis, said first drive device adapted to be engaged with said rigid cylindrical member to rotate said rigid cylindrical member therewith about said central axis;

a second drive device which is connected with at least one of said wheels, said second drive device being adapted selectively to engage said first drive device and to rotate said first drive device and said cylindrical member in one direction about said central axis when said one of said wheels rolls in at least one of said forward and reverse directions along the surface;

said first and second drive devices being relatively moveable between first and second orientations relative to each other, biasing means for biasing said first and second drive devices to said first orientation, said first and second drive devices being moveable to said second orientation against the force of said biasing means;

said second drive device being adapted to engage said first drive device and to rotate said first drive device and said cylindrical member in said one direction about said central axis when said first and second drive devices are in said second orientation and said one of said wheels rolls along the surface.

2. A vehicle structure as defined in claim 1 wherein said first drive device comprises a pair of drive gears disposed on opposite sides of said cylindrical member and rotatable simultaneously in opposite directions relative to each other about said central axis, each of said pair of drive gears being adapted to rotate about said central axis when said first and second drive devices are in said second orientation and said one of said wheels rolls along the surface, and means for coupling one of said pair of drive gears to said cylindrical member to rotate said cylindrical member therewith when said one of said pair of drive gears rotates in said one direction about said central axis, and means for coupling the other of said pair of drive gears to said cylindrical member to rotate said cylindrical member therewith when said other of said pair of drive gears rotates in said one direction about said central axis;

whereby said cylindrical member is rotated in said one direction when said first and second drive devices are in said second orientation and said one of said wheels is rolling in forward or reverse directions along the surface;

3. A vehicle structure as defined in claim 2 including a music box subassembly including a frame comprising a pair of spaced apart side frame members and a cross frame extending between the side frame members;

said music generating device being supported by said frame and being disposed between said side frame members;

said music generating device further comprising a shaft supported by and extending between said side frame members, said shaft having a central axis which coincides with said central axis of said cylindrical member;

said first drive device being supported on said longitudinally extending shaft and being rotatable about said longitudinal central axis of said longitudinally extending shaft;

a pair of opposed, aligned journal bearings in said pair of side frame members for rotatably supporting one wheel axle and for preventing transverse movement of said one wheel axle, and a pair of opposed, aligned slots in said pair of side frame members for rotatably supporting the an other wheel axle and for allowing a predetermined amount of movement of said other wheel axle transverse to the axis of rotation of said other wheel axle;

said second drive device being connected with said other wheel axle and being moveable therewith transverse to the axis of rotation of said other wheel axle; and said first and second drive devices being in said first orientation when said other wheel axle is in a first position in said aligned slots and being in said second orientation when said other wheel axle is in a second position in said aligned slots.

4. A vehicle structure as defined in claim 3 wherein said second drive device comprises a pair of pinion gears connected with said other wheel axle, one of said pinion gears being coupled directly to one of said drive gears when said first and second drive devices are in said second orientation to rotate said one of said drive gears in one direction about said central axis, and an intermediate idler gear between the other of said pair of pinion gears and the other of said pair of drive gears when said first and second drive devices are in said second orientation, to cause said other of said pair of drive gears to rotate about said central axis in a direction opposite to the direction of rotation of said drive gears.

5. A vehicle structure as defined in claim 4, wherein said biasing means comprises a biasing spring which is adapted to act between said frame and said other wheel axle to bias said other wheel axle to said first position in said aligned slots in said pair of side frame members, said other wheel axle being moveable to said second position against the bias of said biasing spring to enable said first and second drive devices to move relative to each other to said second orientation.

6. A vehicle structure as defined in claim 5 wherein said longitudinally extending shaft comprises a longitudinally extending pin and a sleeve surrounding a portion of said longitudinally extending pin and being rotatably supported thereon, each of said pin and said sleeve being rotatable relative to each other about said longitudinally extending central axis, said means for coupling one of said pair of drive gears to said cylindrical member comprising a cylinder disposed on the inside of said cylindrical member and being fixedly connected thereto and respective spring washers disposed between each drive gear and said cylinder; said cylinder being rotatably supported on said sleeve, said cylinder having end faces with drive shoulders integral therewith; one of said pair of drive gears and its respective spring washer being fixed to said longitudinally extending pin and the other of said drive gears and its respective spring washer being fixed to said sleeve; each of said spring washers being adapted to couple its respective drive gear with a drive shoulder on the adjacent end face of said cylinder when its respective drive gear rotates in said one direction about said central axis, and each spring washer being adapted to ratchet over the adjacent end face of said cylinder when its respective drive gear rotates in an opposite direction about said central axis.

7. A vehicle structure as defined in any of claims 3–6 wherein said body comprises a pair of body sections which are joined together to form said body, each of said body sections having an integral bearing for rotatably supporting said one wheel axle and an angular slot for receiving said other wheel axle in a manner that allows said other wheel axle to shift relative thereto.

8. A vehicle structure as defined in claim 7 wherein a linkage connected with said frame and said second drive device is adapted to move said second drive device relative to said frame to move said first and second drive devices to said second orientation; said linkage having a portion selectively engageable with a toy figure which can be coupled with said body to move said first and second drive devices to said second orientation and to maintain said first and second drive devices in said second orientation when said toy figure is in a predetermined position relative to said body.

9. A vehicle structure as defined in any of claims 1–4 wherein a frame supports said music generating device and said first drive device, and a linkage connected with said frame and said second drive device is adapted to move said second drive device relative to said frame to move said first and second drive devices to said second orientation; said linkage having a portion selectively engageable with a toy figure which can be coupled with said body to move said first and second drive devices to said second orientation and to maintain said first and second drive devices in said second orientation when said toy figure is in a predetermined position relative to said body.

10. A vehicle structure as defined in claim 1 wherein said one of said wheels is supported on a wheel axle, and said second drive device comprises a drive pinion supported on said wheel axle and adapted for axial movement relative thereto; said drive pinion being moveable from a first to a second position along said wheel axle to cause said first and second drive devices to move from said first orientation to said second orientation, said biasing means biasing said drive pinion to a first position along said wheel axle, and an actuating member which is selectively moveable against the force of said biasing means to cause said drive pinion to move from said first position to said second position.

11. A vehicle structure comprising a body with an internal cavity, a plurality of wheels connected with said body and adapted to enable said body to roll in forward and reverse directions along a surface, and a music generating device disposed in said internal cavity of said body;

said body having a fanciful external configuration;

said music generating device including a cylindrical member which is rotatable about a central axis thereof to enable said music generating device to generate music;

a drive device connected with at least one of said wheels, said drive device adapted to engage said cylindrical member and to rotate said cylindrical member about said central axis when said one of said wheels rolls along the surface;

said drive device comprising a pair of drive gears rotatable simultaneously in opposite directions relative to each other about said central axis of said cylindrical member, each of said pair of drive gears being adapted to rotate about said central axis when said one of said wheels rolls along the surface;

means for coupling one of said pair of drive gears to said cylindrical member to rotate said cylindrical member therewith when said one of said pair of drive gears rotates in one direction about said central axis, and means for coupling the other of said of said pair of drive gears to said cylindrical member to rotate said cylindrical member therewith when said other of said pair of drive gears rotates in said one direction about said central axis;

whereby said cylindrical member is rotated in said one direction when said one of said wheels is rolling in forward or reverse directions along the surface.

12. A vehicle structure as defined in claim 11, wherein said one of said wheels is supported on a wheel axle, said wheel axle having a pair of pinion gears connected therewith, one of said pinion gears being coupled directly to one of said drive gears to rotate said one of said drive gears about said central axis, and an intermediate idler gear between the other of said pinion gears and the other of said pair of drive gears, to cause said other of said pair of drive gears to rotate about said central axis in a direction opposite to the direction of rotation of said first mentioned drive gear.

13. A vehicle structure as defined in claim 12 wherein said shaft comprises a extending pin and a sleeve surrounding a portion of said pin and being rotatably supported thereon, each of said pin and said sleeve being rotatable relative to each other about said central axis, said means for coupling one of said pair of drive gears to said cylindrical member comprising a cylinder disposed on the inside of said cylindrical member and being fixedly connected thereto and respective spring washers disposed between each drive gear and said cylinder;

said cylinder being rotatably supported on said sleeve, said cylinder having end faces with drive shoulders integral therewith; one of said pair of drive gears and its respective spring washer being fixed to said pin and the other of said drive gears and its respective spring washer being fixed to said sleeve; each of said spring washers being adapted to couple its respective drive gear with a drive shoulder on the adjacent end face of said cylinder then its respective drive gear rotates in said one direction about said central axis, and each spring washer being adapted to ratchet over the adjacent end face of said cylinder when its respective drive gear rotates in an opposite direction about said central axis.

14. A vehicle structure as defined in claim 13 including a music box subassembly comprising a frame including a pair of space apart side frame members and a cross frame extending between the side frame members;

said music generating device being supported by said frame and disposed between said side frame members, said music generating device comprising a shaft supported by and extending between said side frame members, said shaft having a central axis which coincides with said central axis of said cylindrical member;

said pair of drive gears being supported on said longitudinally shaft and located between said side frame members, each of said pair of drive gears and being rotatable about said longitudinal central axis of said shaft; and a pair of opposed, aligned journal bearings in said pair of side frame members for rotatably supporting one wheel axle and preventing transverse movement of said one wheel axle, and a pair of opposed, aligned slots in said pair of side frame members for rotatably supporting the other wheel axle and for allowing a predetermined amount of movement of said other wheel transverse to the axis of rotation of said other wheel axle.

15. A vehicle structure as defined in 14 wherein said body comprises a pair of body sections which can be joined together to from said body; each of said body section having an integral bearing for rotatably supporting said one wheel axle and a slot for receiving said other wheel axle in a manner that allows said other wheel axle to shift relative thereto.

16. A music box subassembly for attachment to a vehicle body, comprising;

a frame comprising a pair of spaced apart, side frame members and a cross frame extending between the side frame members;

a music generating device supported by said frame and disposed between said side frame members, said music generating device comprising a shaft supported by and extending between said side frame members, said shaft having a central axis, and a music generating members supported on said shaft and being rotatable about said central axis of said shaft;

a drive device supported on said shaft and being rotatable about said central axis of said shaft; and means integral with said frame for receiving a pair of wheel axles, comprising a pair of opposed, aligned journal bearings in said pair of side frame members for rotatably supporting one wheel axle and preventing transverse movement of said one wheel axle and a pair of opposed, aligned slots in said pair of side frame members for rotatably supporting the other wheel axle and for allowing a predetermined amount of movement of said other wheel axle transverse to the axis of rotation of said other axle to selectively engage said drive device; and bias means to bias said other wheel axle to one of engagement or disengagement with said drive device.

17. A music box subassembly as defined in claim 16 wherein said drive device comprises a pair of drive gears rotatable simultaneously in opposite directions relative to each other about said central axis of said shaft;

said music generating device comprising a cylindrical member which sequentially engages tone tines when driven;

means for coupling one of said pair of drive gears to said cylindrical member to rotate said cylindrical member therewith when said one of said pair of drive gears rotates in one direction about said central axis of said shaft, and means for coupling the said of said pair of drive gears to said cylindrical member to rotate said cylindrical member therewith when said other of said pair of drive gears rotates in said one direction about said central axis of said shaft;

18. A music box subassembly as defined in claim 17 wherein said shaft comprises a pin and a sleeve surrounding a portion of said pin and being rotatably supported thereon, each of said pin and said sleeve being rotatable relative to each other about said central axis, said means for coupling one of said pair of drive gears to said cylindrical member comprises a cylinder disposed on the inside of said cylindrical member and being fixedly connected thereto and respective spring washers disposed between each drive gear and said cylinder; said cylinder being rotatably supported on said sleeve, said cylinder having end faces with drive shoulders integral therewith; one of said pair of drive gears and its respective spring washer being fixed to said longitudinally extending pin and the other of said drive gears and its respective spring washer being fixed to said sleeve; each of said spring washers being adapted to couple its respective drive gear with a drive shoulder on the adjacent end face of said cylinder when its respective drive gear rotates in said one direction about said central axis, and each spring washer being adapted to ratchet over the adjacent end face of said cylinder when its respective drive gear rotates in an opposite direction about said central axis.

* * * * *

UNITED STATES PATENT AND TRADEMARK OFFICE

CERTIFICATE OF CORRECTION

PATENT NO. : 5,011,451

DATED : April 30, 1991

INVENTOR(S) : Eugene S. Holtier

It is certified that error appears in the above-identified patent and that said Letters Patent is hereby corrected as shown below:

Column 12, line 20, please delete "along the surface;" and insert therefor --along the surface.--.

Column 12, lines 33,34, after "supported on said", please delete "longitudinally extending".

Column 12, lines 35,36, after "axis of said", please delete "longitudinally extending".

Column 12, line 42, after "supporting the", please delete "an".

Column 13, line 11, please delete "longitudinally extending".

Column 13, lines 11,12, after "shaft comprises a", please delete "longitudinally extending".

Column 13, lines 15,16, after "other about said", please delete "longitudinally extending".

Column 13, line 25, after "fixed to said", please delete "longitudinally extending".

UNITED STATES PATENT AND TRADEMARK OFFICE

CERTIFICATE OF CORRECTION

PATENT NO. : 5,011,451

DATED : April 30, 1991

INVENTOR(S) : Eugene S. Holtier

It is certified that error appears in the above-identified patent and that said Letters Patent is hereby corrected as shown below:

Column 14, line 39, after "the other of", please delete "said of".

Column 14, line 60, please delete "shaft comprises a extending" and insert therefore --wheel axle comprises a--.

Column 15, line 5, after "other of said", please insert --pair of--.

Column 15, line 9, please delete "said cylinder then" and insert therefor --said cylinder when--.

Column 15, line 17, please delete "pair of space" and insert therefor --pair of spaced--.

Column 15, lines 26,27, after "supported on said", please delete "longitudinally".

Column 15, line 28, after "drive gears", please delete "and".

Column 15, line 40, after "as defined in" please insert --claim--.

Column 15, line 43, please delete "section having" and insert therefor --sections having--.

UNITED STATES PATENT AND TRADEMARK OFFICE

CERTIFICATE OF CORRECTION

PATENT NO. : 5,011,451

DATED : April 30, 1991

INVENTOR(S) : Eugene S. Holtier

It is certified that error appears in the above-identified patent and that said Letters Patent is hereby corrected as shown below:

Column 15, line 57, please delete "generating members" and insert therefor --generating member--.

Column 16, line 30, please delete "said of said pair" and insert therefor --other of said pair--.

Column 16, line 34, please delete "of said shaft;" and insert therefor --of said shaft.--.

Column 16, lines 48,49, after "fixed to said", please delete "longitudinally extending".

Signed and Sealed this

Second Day of February, 1993

*Attest:*

STEPHEN G. KUNIN

*Attesting Officer*

*Acting Commissioner of Patents and Trademarks*